US005396916A

United States Patent [19]

Boissonnault

[11] Patent Number: 5,396,916

[45] Date of Patent: Mar. 14, 1995

[54] BEACH UMBRELLA ANCHORING DEVICE

[76] Inventor: Robert Boissonnault, P.O. Box 2224, Teaticket, Mass. 02536

[21] Appl. No.: 218,673

[22] Filed: Mar. 25, 1994

[51] Int. Cl.[6] ..... A45B 3/00

[52] U.S. Cl. ..... 135/16; 248/530; 52/157; 135/19; 135/98

[58] Field of Search ..... 135/16, 118, 19, 20.1, 135/98, 99; 248/530; 52/155, 156, 157

[56] References Cited

U.S. PATENT DOCUMENTS

| | | | |
|---|---|---|---|
| 1,243,153 | 10/1917 | Gabler | 135/20.1 |
| 1,996,071 | 4/1935 | Kahn | 135/20.1 |
| 3,044,478 | 7/1962 | Russell | 135/20.1 |
| 4,582,078 | 4/1986 | Ma | 135/20.1 X |
| 5,088,681 | 2/1992 | Procaccianti et al. . | |
| 5,122,014 | 6/1992 | Genfan . | |
| 5,143,108 | 9/1992 | Kenney . | |
| 5,152,495 | 10/1992 | Jacinto et al. | 248/530 X |
| 5,156,369 | 10/1992 | Tizzoni | 248/530 X |

FOREIGN PATENT DOCUMENTS

| | | | |
|---|---|---|---|
| 671327 | 2/1966 | Belgium | 248/530 |
| 0312675 | 4/1989 | European Pat. Off. | 135/16 |
| 0522123 | 5/1957 | Italy | 135/118 |
| 1278557 | 6/1972 | United Kingdom | 135/16 |

*Primary Examiner*—Lanna Mai
*Attorney, Agent, or Firm*—Thomas A. Kahrl

[57] ABSTRACT

A shading device including an umbrella-like canopy comprising a collapsible frame and a flexible light-proof covering with a anchoring device for supporting the shade device above ground so that the canopy will serve as a sun shade, particularly for blocking the rays of the sun wherein the anchoring device including an offset support arm for overhanging the canopy and a anchoring helix adapted to be driven into the ground for providing support to the shading device, said anchoring device is mounted to the other end of a crankshaft with a hand crank for rotating the crankshaft in screw fashion to drive the anchoring helix to impart rotational force to drive the helical member of the anchoring device into the ground for anchoring.

6 Claims, 3 Drawing Sheets

BEACH UMBRELLA ANCHORING DEVICE

BACKGROUND OF THE INVENTION

It is now recognized that protecting sun bathers exposed outdoors to the harmful rays of sunlight is desirable. Such protection is particularly important when a person is at the shore or in a beach environment for an extended period of time. In the past, protection has been provided for sun bathers with large beach umbrellas placed in the sand. Problems with the use of beach umbrellas are primarily wind related, i.e. a beach umbrella can be easily blown over and blown down wind posing a risk to other persons in its path.

Attempts have been made to provide anchoring mechanisms for beach umbrellas having a removable attachment to the ground or the umbrella to withstand wind or other forces that tend to remove it from its location. Applicant is aware of attempts to solve this problem by providing an anchoring mechanism at the base of the umbrella to bury in the ground to provide an anchor. One such attempt was disclosed in U.S. Pat. No. 4,850,564, which includes a base member and pin members used to drive a helical assembly into the ground. Other prior art devices include U.S. Pat. No. 1,736,177 following a helical assembly which is manually operated and lacks a driving means for driving it into the ground. Other prior art patents include U.S. Pat. Nos. 5,152,495 Jacinto et al, 5,088,691 Procaccianto et al., 5,143,108 Kenney; 5,156,369 Tizzoni and 5,122,014 Genfan which provide for a number of relatively complicated features which fail to solve the problem in an efficient and economical way. None of these patents suggest the novel feature of the present invention.

Accordingly, it is therefore desirable to provide for a new and improved combination of sun shade device which includes a support and a helical anchoring device wherein a cranking device may be employed to drive the anchoring mechanism into the ground so that the sun shade device can be securely supported and which overcomes at least some of the disadvantages of prior art.

SUMMARY OF THE INVENTION

The present invention is directed to a shading device including a canopy for shade and a rotary anchoring device for anchoring the canopy to the ground. In particular, the present invention is directed to an anchoring device adapted to be driven into the ground, typically a sandy beach, to provide support for the shading device wherein the anchoring device is connected to a rotary driving apparatus operated by a hand crank for effortlessly anchoring the canopy in a beach environment.

The shading device in the present invention includes a support column for supporting the canopy above ground so that the canopy will serve as a sun shade and also includes an offset articulated shaft for overhanging the canopy so that the support column will not interfere with the area to be shaded. Anchoring is accomplished by providing a helical anchoring device connected to one end of a crankshaft and a driving mechanism connected to the other end. The driving mechanism consists of a hand crank for turning the crankshaft thereby rotating the helical anchoring device and imparting rotational force to drive said helical anchoring device into the ground for supporting the canopy.

The present invention is further directed to an alternate embodiment which is directed to an anchoring tube adapted for use with a shading device such as a conventional beach umbrella having a pole used for support of the umbrella. The anchoring tube includes an elongated tubular column having a hollow central cavity, having a collar at the top end, including an aperture for mounting the shaft of a beach umbrella, and having a cap at the bottom for mounting an anchoring device. In particular, the anchoring tube is adapted to be driven into the ground for providing support of the tubular column and thereby to the beach umbrella. Anchoring is provided by a helical screw member attached securely to the cap fixed at the bottom end of the tube. The top collar includes a driving member which includes a handle fastened to a hinge on the circumference of the collar. The collar surrounds the top end of the elongated tubular member such that the handle is held in fixed relation to the tubular member. The collar further includes a spring biasing member, normally biased inwardly, for locking the pole device relative to the anchoring tube. In operation, when the handle is rotated, the tubular member is also rotated thereby rotating the helical device such that it is driven into the ground in a screw-like fashion for providing a secure anchor for a beach umbrella.

The invention will be described for the purposes of illustration only in connection with certain embodiments. However, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 2:
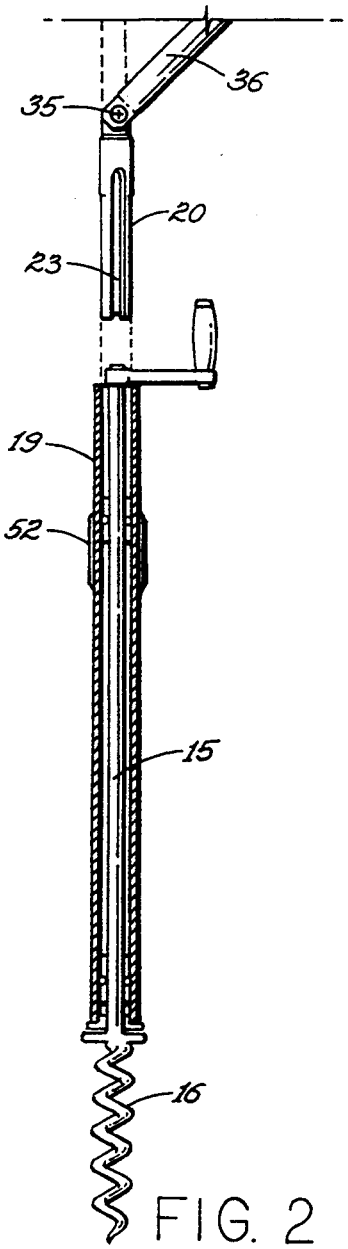
FIG. 2 is an enlarged fragmentary view of the shading device of FIG. 1 shown in cross-section with an articulated shaft in the detached position.

Referring to the drawings, there is shown a shading device in combination with a helical support apparatus 10 consisting of a canopy 12 supported by an articulated shaft assembly 13 supported in a tubular shaped support column 14. As is shown in FIG. 2, the support column 14 has a top end, a bottom end and a hollow central cavity including a crankshaft 15. A corkscrew 16 is connected to the bottom end and is configured to be operated by a hand crank 18 mounted on the top end of the support column 14.

Figure 1:
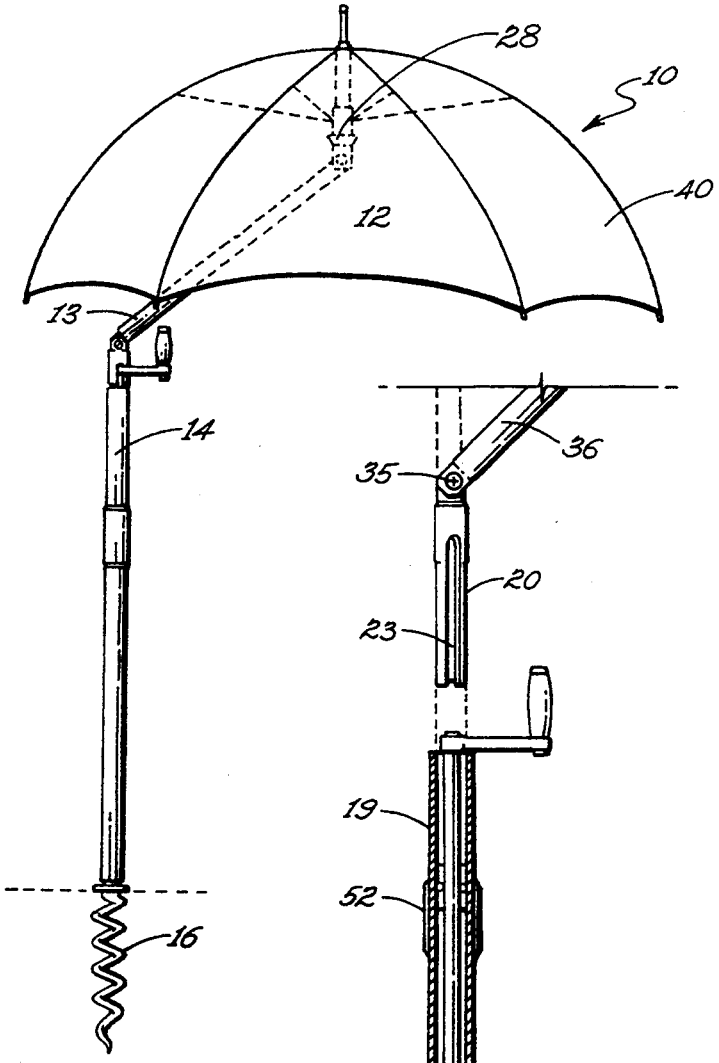
FIG. 1 is a side elevational view of a shading device of the present invention shown with a helical support driven into the ground and showing a canopy in an extending/offset position.

As is shown in FIG. 1, the canopy is supported on an articulated shaft 13 in a manner such that said canopy overhangs a shaded area on the ground, typically including a beach towel 22, such that the support column 14 does not interfere with said shaded area or a person situated thereon for sunshade. As is shown in FIG. 2, the crankshaft 15, has a top end and a bottom end and extends between the hand crank 18 and the corkscrew 16. The hand crank 18 is securely attached to the top end of the crankshaft 15 and is positioned in an engagement housing 19 including bearings 21 which support the crankshaft 15 so that the hand crank 18 can freely rotate relative to the support column 14. The crankshaft 15 is of elongated configuration and is coaxially positioned within the support column 14. The crankshaft 15 is of tubular construction and is rotably supported therein by bearings 21.

Figure 3:
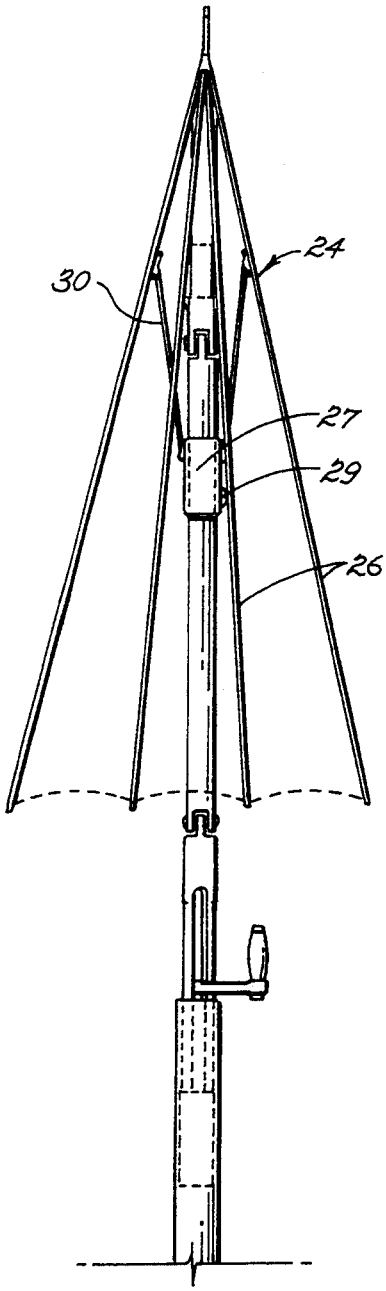
FIG. 3 is an enlarged fragmentary view of the shading device of FIG. 1 shown with the canopy in section in the retracted position with the articulated shaft in the upright position.
Figure 4:
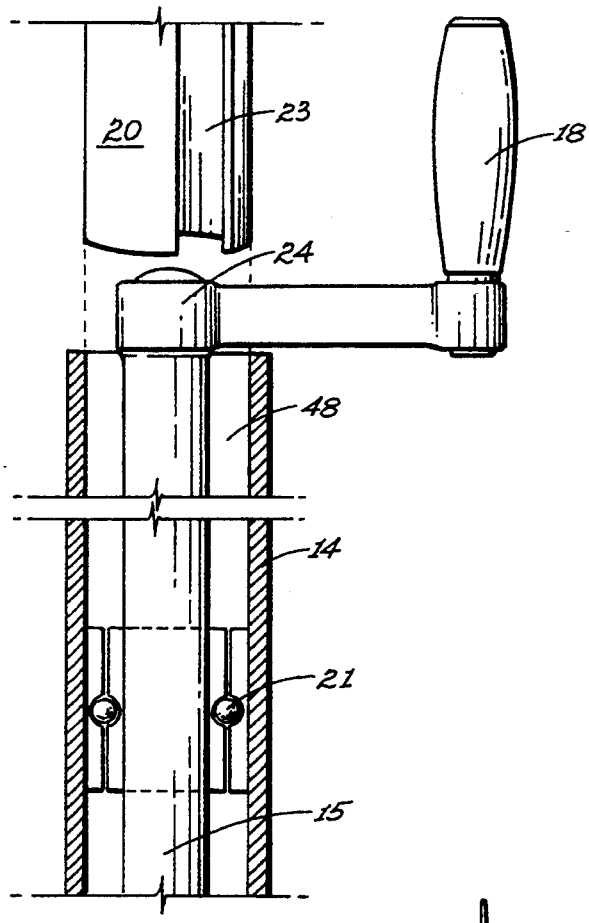
FIG. 4 is an enlarged fragmentary side view of the hand crank shown mounted on a support column in section with the articulated shaft shown detached of the invention of FIG. 1.
Figure 5:
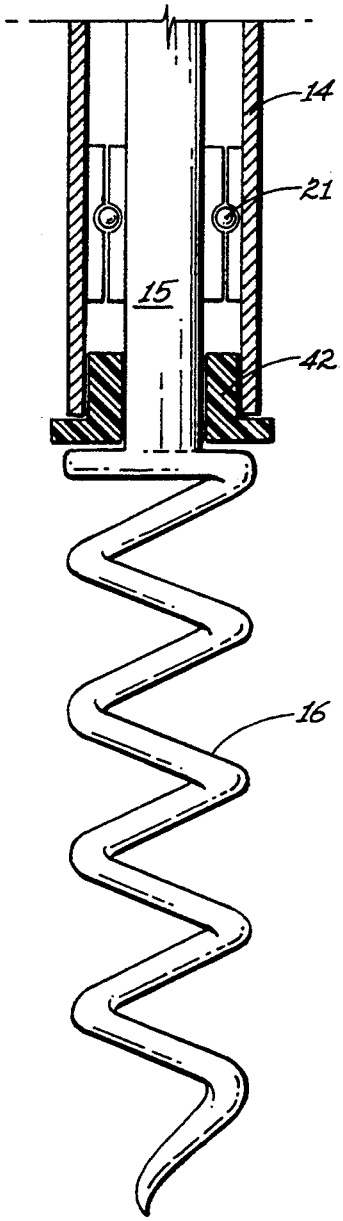
FIG. 5 is an enlarged fragmentary view of the helical support device of the invention of FIG. 1.
Figure 6:
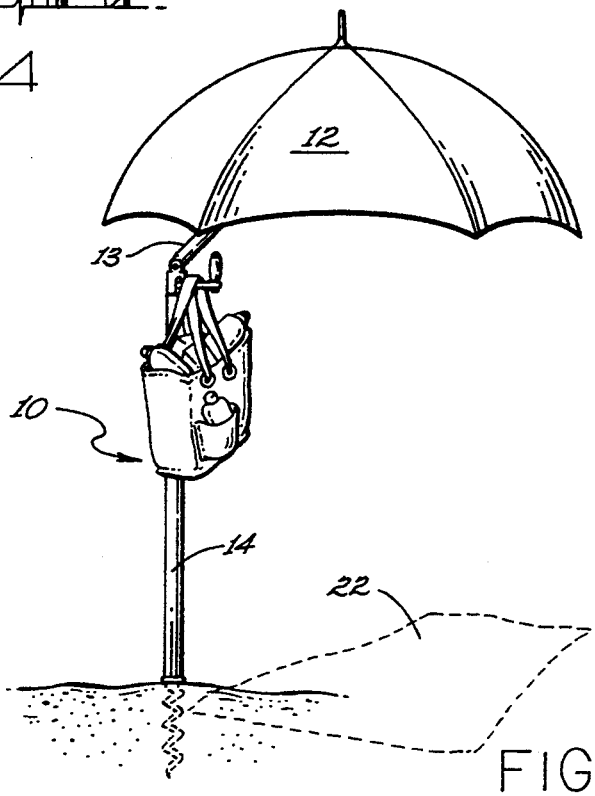
FIG. 6 is an elevational view from above of the shading device of FIG. 1 positioned with the canopy overhanging a shaded beach towel area.
Figure 7:
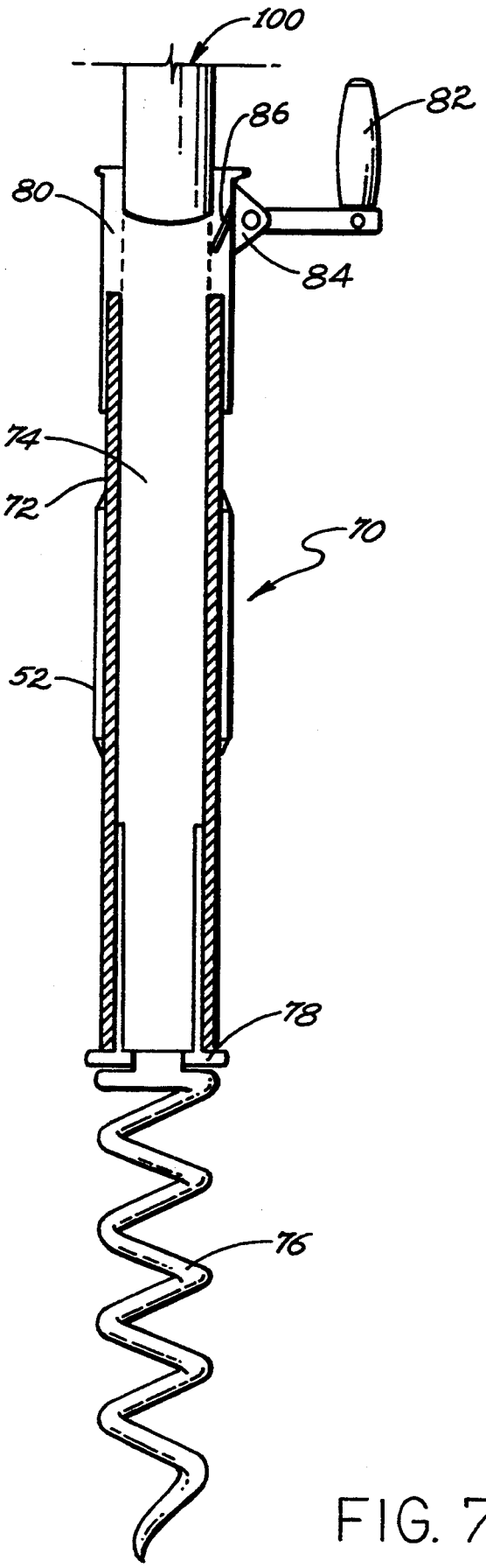
FIG. 7 is a fragmentary side elevational view in section of an alternate anchoring arrangement of the present invention showing a hand crank attached to the top of an anchoring tube.

As is shown in FIGS. 2, 3 & 4, the canopy 12 is connected to the support column 14 by a stub shaft 20. The support column 14 has a longitudinal groove 23 adapted to surround the top end of the crankshaft 15 and the hub 25 of the hand crank 18. The stub shaft 20 is mounted within the engagement housing 19 engaging the hand crank 18 along the groove 23 permitting the hand crank 18 to pivot.

Referring to the drawings, FIGS. 1 and 3 show a support frame 24 consisting of collapsible struts 26 which are interconnected for supporting the canopy 12, said struts being connected in a collapsible manner and being mounted on a connector sleeve 27. The connector sleeve 27 is slidably mounted on the arm segment 28 of an articulated shaft 13. The connector sleeve 27 includes a conventional locking means to lock the sleeve in a down, "closed position" or in an upward, "erected position". The frame structure 24 is movably positioned on the arm segment 28 to move between the "erected position" and the "closed position" wherein the locking means includes a releasable latch mechanism 29 and lower strut elements 30 being respectively, pivotally connected to an annular sleeve 32 and mounted on the articulated shaft 13.

The articulated shaft 13 consists of a base tubular member 34. The base tubular member 34 has a first end and second end and includes a hollow groove 23 connected by a hinge 35 to an angled tubular member 36 having a first and second end, being connected at the first end to said base tubular member by said hinge at the second end for connecting to the shaft 13.

The canopy 12 includes a flexible sun proof and waterproof covering 40. The canopy 12 includes a connecting means 42 for connecting the struts 26 and said frame member 24 to said flexible canopy 12. The support column 14 includes a longitudinal access way 48 for encompassing the crankshaft 15 disposed in coaxial relationship with respect to said longitudinal access way 48 and being rotatable with said access by rotation of the hand crank 18.

The present invention is arranged with the helical corkscrew 16 rigidly mounted to one end of the crankshaft 15 such that said helical member may be corkscrewed into the beach at the base of the support column 14. To operate the combined shading device with helical support 10, one positions the helical corkscrew 16 in the sand, grips the support column 14 at a hand grip 52 and cranks the hand crank 18 thereby causing the crankshaft 15 to rotate. This in turn turns the helical corkscrew 16 and thus imbeds it into the ground, typically beach sand, to a depth that will secure the canopy 12 and keep it from blowing over.

The offset canopy in operation is easy to use and enables a person to secure a safe canopy installation. It could particularly be a very practical and popular item for sunbathing enthusiasts whether at the beach or elsewhere.

The invention includes an alternate embodiment of an anchoring tube 70 for use with a shading device 100 typically a conventional beach umbrella having a conventional pole used for support of said beach umbrella. In particular, the anchoring tube 70 consists of a tubular column 72 including a hollow central cavity 74 which is adapted to accept the end of said pole. The tubular column 72 has a top end and a bottom end and includes an anchoring device 76. The anchoring device 76 is adapted to be driven into the ground and provides support to the tubular column 72 and to the shading device 100 supported therein. The anchoring device 76 consists of a helical screw element which is attached to the bottom end of tubular column 72 by a bottom cap 78 which is adapted to be inserted in the hollow central cavity 74 for engagement with said anchoring tube 70. A driving collar 80 is attached to the top end of the tubular column 72 having a circular cross-sectional shape including a hand crank 82 wherein the interior diameter of said driving collar is the same of the interior diameter of said support tube adapted for accepting a distal end of the pole of the shading device (100). The hand crank 82 is fastened to a hinge 84 positioned on the circumference of the driving collar 80. The driving collar 80 surrounds said tubular member column and the hand crank 82 is held in fixed relationship to the tubular column 72. Included in the driving collar 80 is a spring biased member 86 for engaging said pole. In operation, the hand crank 82 is adapted for rotating the driving collar 80 with the helical element 76 firmly secured to the bottom end of said tubular column 72 to impart rotational force to drive the said helical element into the ground for anchoring.

What is claimed is:

1. An anchoring tube device in combination with a shading device comprising;

a) the shading device comprises a beach umbrella having a pole used for support of said umbrella, said pole having a distal end;

b) a tubular column having a top end and bottom end and a hollow central cavity configured to accept the distal end of the pole;

c) fastening means comprising a fastening cap connected in secure engagement to the bottom end of said tubular column;

d) anchoring means adapted to be driven into the ground for providing support to the tubular column and associated shading device supported therein comprising a helical screw attached to the fastening means and extending downwardly therefrom;

e) a driving collar attached to the top end of said anchoring tube having a circular cross-sectional shape; said driving collar includes a spring biased member to engage said pole and f) a driving means fixedly connected to the driving collar wherein said driving means remains fixedly connected to said driving collar when said pole is in place within said central cavity; said driving means is employed to rotate said anchoring tube and said anchoring means for driving the anchoring means in screw fashion into the ground.

2. The anchoring tube of claim 1 wherein the driving means includes a hand crank fastened to a hinge member on the driving collar.

3. The anchoring tube of claim 1 wherein the driving collar surrounds said elongated tubular member such that the hand crank is held in fixed relation to the tubular member.

4. The anchoring tube of claim 1 wherein the driving collar includes a spring biasing member for engaging said pole.

5. The anchoring tube of claim 1 wherein there is mounted an elongated outer tubular member having an upper end and a lower end and further including a gripping segment.

6. The anchoring tube of claim 1 wherein the interior diameter of the collar is the same as the interior of the anchoring tube for accepting the distal end of the support structure.

* * * * *